US011406998B2

(12) United States Patent
Richter et al.

(10) Patent No.: US 11,406,998 B2
(45) Date of Patent: Aug. 9, 2022

(54) ROTATIONAL UNIT HAVING A HOLLOW-SHAFT MOTOR

(71) Applicant: VOLKSWAGEN AKTIENGESELLSCHAFT, Wolfsburg (DE)

(72) Inventors: Stefan Richter, Roetgesbuettel (DE); Mike Hirschfeldt, Braunschweig (DE); Klaus Stefan Klimek, Bovenden (DE); Philipp Marian Mueller, Braunschweig (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 372 days.

(21) Appl. No.: 16/831,171

(22) Filed: Mar. 26, 2020

(65) Prior Publication Data

US 2020/0222931 A1 Jul. 16, 2020

Related U.S. Application Data

(63) Continuation of application No. PCT/EP2018/075667, filed on Sep. 21, 2018.

(30) Foreign Application Priority Data

Sep. 26, 2017 (DE) ..... 10 2017 217 069.7

(51) Int. Cl.
*B05B 13/00* (2006.01)
*B05B 13/02* (2006.01)
(Continued)

(52) U.S. Cl.
CPC ..... *B05B 13/0207* (2013.01); *B05B 3/025* (2013.01); *F02F 1/004* (2013.01);
(Continued)

(58) Field of Classification Search
CPC ..... B05B 13/0627; B05B 13/0431; B05B 13/0278; B05B 13/041; B05B 1/1636;
(Continued)

(56) References Cited

U.S. PATENT DOCUMENTS 2,168,807 A 8/1939 Schlüpmann
4,252,763 A 2/1981 Padgett
(Continued)

FOREIGN PATENT DOCUMENTS

CN 104415868 A 3/2015
CN 104640339 A 5/2015
(Continued)

OTHER PUBLICATIONS

Dynamic Sealing Technologies, Inc.: Rotary union solutions—Revision 1.2. Andover, Mn., USA, 2015, pp. 1-16. URL: https://www.dsti.com/pdfs/cataloqs/DSTI-SPS-Series-Catalog.pdf.
(Continued)

*Primary Examiner* — Long T Tran
(74) *Attorney, Agent, or Firm* — Muncy, Geissler, Olds & Lowe, P.C.

(57) ABSTRACT

In order to create a rotating unit for a coating lance device for thermally coating an interior, it is provided that the rotary drive is implemented as a hollow-shaft motor coaxial with the axis of rotation of the tool holder, and wherein the tool holder and the coating material feed, as well as the process media feed, are located centrally relative to the hollow-shaft motor. Furthermore, in order to create a coating lance device for thermally coating an interior, it is proposed to provide such a rotating unit; at least one linear actuator for axial and/or lateral positioning of the rotating unit relative to an interior to be coated; and stationary supply connections for supplying electricity to the coating lance, and for the coating material feed, and for the process media feed.

6 Claims, 3 Drawing Sheets

(51) Int. Cl.
*F02F 1/00* (2006.01)
*B05B 3/02* (2006.01)

(52) U.S. Cl.
CPC ..... *B05B 13/0221* (2013.01); *F02F 2001/008* (2013.01); *F02F 2200/00* (2013.01)

(58) Field of Classification Search
CPC ..... B05B 13/0421; B05B 13/0609; B05B 13/0636; F02F 1/004; F02F 2001/008; F02F 2200/00
See application file for complete search history.

(56) References Cited

U.S. PATENT DOCUMENTS

| | | | | |
|---|---|---|---|---|
| 4,309,958 | A * | 1/1982 | Jennings | B05C 7/08 118/DIG. 10 |
| 7,842,901 | B2 | 11/2010 | Wawers et al. | |
| 10,286,417 | B2 | 5/2019 | Ebenbeck et al. | |
| 10,525,603 | B2 | 1/2020 | Tomuta et al. | |
| 2013/0216716 | A1* | 8/2013 | Strohlein | B05B 13/0627 239/587.5 |
| 2014/0263703 | A1* | 9/2014 | Waitlevertch | B01F 27/071 74/25 |
| 2016/0207056 | A1* | 7/2016 | Schübel | B05B 12/20 |
| 2017/0138396 | A1* | 5/2017 | Latham | F16C 33/64 |
| 2018/0003474 | A1* | 1/2018 | Aufschläger et al. | G01B 11/14 |
| 2018/0010905 | A1* | 1/2018 | Wimmer | B05D 1/02 |
| 2019/0001364 | A1 | 1/2019 | Antolotti et al. | |
| 2020/0140986 | A1* | 5/2020 | Schwarz | C23C 4/131 |

FOREIGN PATENT DOCUMENTS

| | | | |
|---|---|---|---|
| CN | 204634143 | U | 9/2015 |
| CN | 206424088 | U | 8/2017 |
| DE | 3241710 | A1 | 5/1984 |
| DE | 3919699 | A1 | 1/1991 |
| DE | 19501026 | A1 | 7/1996 |
| DE | 19841617 | A1 | 3/2000 |
| DE | 102005047328 | B3 | 12/2006 |
| DE | 102011114395 | A1 | 3/2013 |
| DE | 102012109203 | B3 | 11/2013 |
| DE | 102014200633 | B3 | 5/2015 |
| DE | 102015104492 | A1 | 9/2016 |
| EP | 1350862 | A1 | 10/2003 |
| GB | 2079637 | A | 1/1982 |
| HU | E030617 | T2 | 5/2017 |
| JP | 58004926 | A2 | 1/1983 |
| JP | 5320951 | B2 | 10/2013 |
| WO | WO2016/015922 | A1 | 2/2016 |
| WO | WO2017/103868 | A1 | 6/2017 |

OTHER PUBLICATIONS

Chinese Office Action dated Dec. 16, 2020 in corresponding application 201880062723.0.

* cited by examiner

ROTATIONAL UNIT HAVING A HOLLOW-SHAFT MOTOR

This nonprovisional application is a continuation of International Application No. PCT/EP2018/075667, which was filed on Sep. 21, 2018, and which claims priority to German Patent Application No. 10 2017 217 069.7, which was filed in Germany on Sep. 26, 2017, and which are both herein incorporated by reference.

BACKGROUND OF THE INVENTION

Field of the Invention

The present invention relates to a rotating unit for a coating lance device, and a coating lance device for thermally coating an interior, preferably a cylinder bore of an engine block.

Description of the Background Art

More and more emphasis is being placed on lightweight construction in the manufacture of engine blocks. Aluminum engine blocks are used for this purpose, although they require a friction-reduced coating in the region of the cylinder barrel, especially when the cylinder heads are also made of aluminum. One established coating method is thermal coating, for example plasma spraying. Positive effects of this coating, in addition to an improvement in robustness of the cylinder barrel, include a considerable reduction in friction in the region of the piston assembly, resulting in a reduction in carbon dioxide emission and good protection from corrosive media.

Current thermal coating methods include powder plasma spraying, wire spraying methods such as plasma transfer wire arc (PTWA) and twin wire arc spraying (LDS), and HVOF spraying (high velocity oxygen fuel spraying). Because of the cramped conditions when a cylinder barrel of a cylinder bore is being coated, rotating coating lances are used that can be introduced axially into the cylinder bore.

One such coating lance is known from, for example, WO 2016/015 922 A1, which corresponds to U.S. Pat. No. 10,286,417, which concerns a device and a method for metallic coating and a holding unit for this device, for example on page 2, first through third paragraphs.

At present, no rotating unit exists for a coating lance device for thermally coating an interior with rotary feed-through for gas, cooling water, and sprayed material that satisfies industrial requirements for high-volume production of cylinder blocks.

A rotation unit is currently offered by the Oerlikon Metco company. In this case, the rotary drive is designed as a belt drive. Maximum speeds at present are 250 revolutions per minute to a maximum of 800 RPM in the case of newer developments. The speed is limited here as a result of the belt tension and the vibrations resulting from it.

SUMMARY OF THE INVENTION

It is therefore an object of the present invention to reduce the moving mass of the overall coating lance device in the case of a rotating device and to increase the speed in a vibration-free manner, because superimposed vibrations strongly affect the coating result and dramatically reduce the service life of the process unit used, for example a robot or gantry. It is also the object to reduce acquisition costs, operating costs, and manufacturing costs.

In an exemplary embodiment, the rotary drive is implemented as a hollow-shaft motor coaxial with the axis of rotation of the tool holder, and wherein the tool holder and the coating material feed, as well as the process media feed, are located centrally relative to the hollow-shaft motor.

In addition, a reduction in the co-moving mass is achieved through a use of the rotating device of the type proposed here.

According to an exemplary embodiment of the invention, a rotating unit for a coating lance device for thermally coating an interior, preferably a cylinder bore of an engine block, is proposed, wherein the rotating unit has at least the following components: a tool holder for a coating lance with an axis of rotation; a rotary drive for rotating the tool holder about the axis of rotation; a coating material feed for supplying the coating lance with a coating material; and a process media feed for providing process media for coating an interior by means of a coating lance mounted in the tool holder.

The rotation unit is primarily characterized in that the rotary drive is implemented as a hollow-shaft motor coaxial with the axis of rotation of the tool holder, wherein the tool holder and the coating material feed as well as the process media feed are located centrally relative to the hollow-shaft motor.

In contrast to previously known implementations, the proposed rotating unit has a hollow-shaft motor as the rotary drive. This has the advantage that all media (gases, cooling water, coating material, and electric power) can be fed centrally. Any vibrations that arise thus depend solely on the balance quality of the centrally located and co-rotating components. Consequently, very high speeds can be achieved, for example 150 revolutions per minute to 900 revolutions per minute, or even up to 1000 revolutions per minute. In this way, production time is shortened. Furthermore, the entire structure of the rotating unit can be implemented with a lower mass. In this way, positioning of the rotating unit or of the coating lance that is mounted in the tool holder is made possible with lower actuator forces. Alternatively or in addition, positioning and advancing of the rotating unit is allowed with reduced expenditure of time and/or with fewer vibrations induced by moments of inertia. Moreover, the vibrations induced in the aligning system are reduced due to the reduction in vibrations during operation of the rotating unit.

As is known from the prior art, the tool holder is equipped to mount a coating lance. The tool holder is rotated about its axis of rotation by the rotary drive. In addition, the tool holder has suitable media outlets that correspond to the media inlets of the relevant coating lance. The media outlets of the tool holder are equipped with a coating material feed and a process media feed as well as an electric power feed for the coating lance. These are arranged centrally relative to the hollow-shaft motor and rotate with the tool holder, or they are stationary and are connected to the relevant outlet through a suitable bearing. According to an especially preferred embodiment, for example, the coating material is provided through a central coating material feed, and the process media is provided through a process media feed that is located radially outward therefrom and preferably surrounds it continuously, and these are connected to the tool holder in a fixed, which is to say co-rotating, manner. All of these components are arranged to be coaxial with one another. In this design, the hollow-shaft motor is located at least over an axial section of the process media feed and acts on a rotor, preferably the armature, that is connected to the process media feed in a fixed manner. The coaxial sequence of arrangement of the coating material feed and the process media feeds is freely selectable. However, it is advantageous to arrange the coating material feed centrally, because in this way the coating material can be fed centrally to the connected coating lance without great effort.

The construction as a whole is significantly less complex and has a significantly lower number of individual parts, so that the acquisition costs for such a rotating unit are lowered. Moreover, the mass of such a rotating unit is significantly reduced as compared with a rotating unit having a belt drive, so that the co-moving mass for positioning of the rotating unit relative to a workpiece or the interior to be coated is reduced.

A slip ring assembly for transmitting electric power to the coating lance can be located radially outside the hollow-shaft motor.

A slip ring assembly can be provided for supplying the burner of the coating lance with electric power. The hollow-shaft motor is preferably brushless in design.

An exhaust system for removing slip ring dust from the slip ring assembly can be provided, and preferably at least one air jet is also provided by means of which removal of the slip ring dust can be assisted.

The exhaust system can be provided to specifically remove slip ring dust that arises. In this design, preferably at least one air jet is provided, which does not deliver more volume than is removed through the exhaust system, however. In this way, shielding from slip ring dust that arises from the thermal coating process is sufficiently ensured. In the prior art, universal couplings are used in which current carriers create considerable dust, which is blown off with compressed air, and thus can lead to contaminants in the coating. Due to the deposition of conductive dusts, the possibility of an arc discharge exists, with the risk of destroying the rotating unit.

The tool holder can be equipped to mount different coating lances, and preferably has a zero point marking for precisely repeatable alignment of a relevant coating lance, and especially preferably includes a reader for reading an identification information item of the applicable mounted coating lance.

It is now proposed here to provide a zero point marking so that a wide variety of coating lances can be installed in a manner that can easily be recognized and verified as correct. It is especially preferred for the tool holder to have a standardized connection or multiple adapters for different connections for different coating lance types.

It is most especially preferred for the tool holder to be equipped with a reader, preferably an electronic reader, and for the coating lance to have a readable identification unit, for example an RFID chip. Information concerning the coating lance can be obtained from this identification unit, and the coating lance can be correctly positioned and operated as a result. Alternatively, access to stored data is made possible in the operating system by means of which the rotating unit is controlled, so that the coating lance can be operated correctly in accordance with its type and/or its individual (historical) characteristics. In addition, this identification unit or the associated stored information in the operating system can contain instructions for the worker on correct installation of this coating lance in the tool holder. In this way, improved accuracy of the spray distance, insertion depth, and other parameters can be achieved. For quality assurance, the tool data can be associated with the components being processed. Moreover, a history can be generated from which the operating hours can be reliably stored in order to gather experience as to when preventive maintenance must be carried out in future.

The coating material can be provided in powder form, and at least one gas-tight, encapsulated roller bearing is provided for coupling in coating material, wherein preferably the roller bearing is at least partially made of ceramic.

The coating material can be provided in powder form, which is to say for powder plasma spraying. In previous rotating units, sealing Teflon caps or air-flushed ceramic disks are used for this purpose. Such devices have short service lives. It is now proposed here for a gas-tight and encapsulated roller bearing to be used, as a result of which the coupling has low wear. It is especially preferred for ceramic rollers and/or ceramic running surfaces to be used, so that a lubrication-free and nonetheless low-wear and low-abrasion embodiment with a long service life is made possible. A gas-tight and encapsulated roller bearing is known, for example, as a rotating unit (rotary union solutions) from the firm DSTI (Dynamic Sealing Technologies, Inc.), 13829 Jay Street NW, Andover Minn. 55304, USA, in the "SPS Series" product line (see https://www.dsti.com/industries, document: "DSTI-SPS-Series-Catalog.pdf," published 20 May 2015).

A coating lance device for thermally coating an interior, preferably a cylinder bore of an engine block, is also provided, wherein the coating lance device has at least the following components: at least one rotating unit according to an embodiment in accordance with the above description; at least one linear actuator for axial and/or lateral positioning of the rotating unit relative to an interior to be coated; and stationary supply connections for supplying electricity to the hollow-shaft motor and the coating lance, and for the coating material feed and the process media feed.

The coating lance device has a rotating unit that is characterized by simple construction, low mass, and low rotationally-caused vibration in operation. This results in lower holding forces and positioning forces. In addition, significantly longer service lives are achieved as a result of lower vibration loading for the positioning unit. The housing can be equipped to hold the rotation unit on a linear actuator. Moreover, a process box is preferably provided, which preferably is equipped such that it forms a receiving space for the coating lance in the withdrawn state, which is to say when a coating stream is still being produced but no coating of a workpiece is to be carried out. Moreover, the coating lance device has the appropriate connections for operating the rotating device and the coating lance, wherein these can be moved solely horizontally, or vertically, or not at all.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
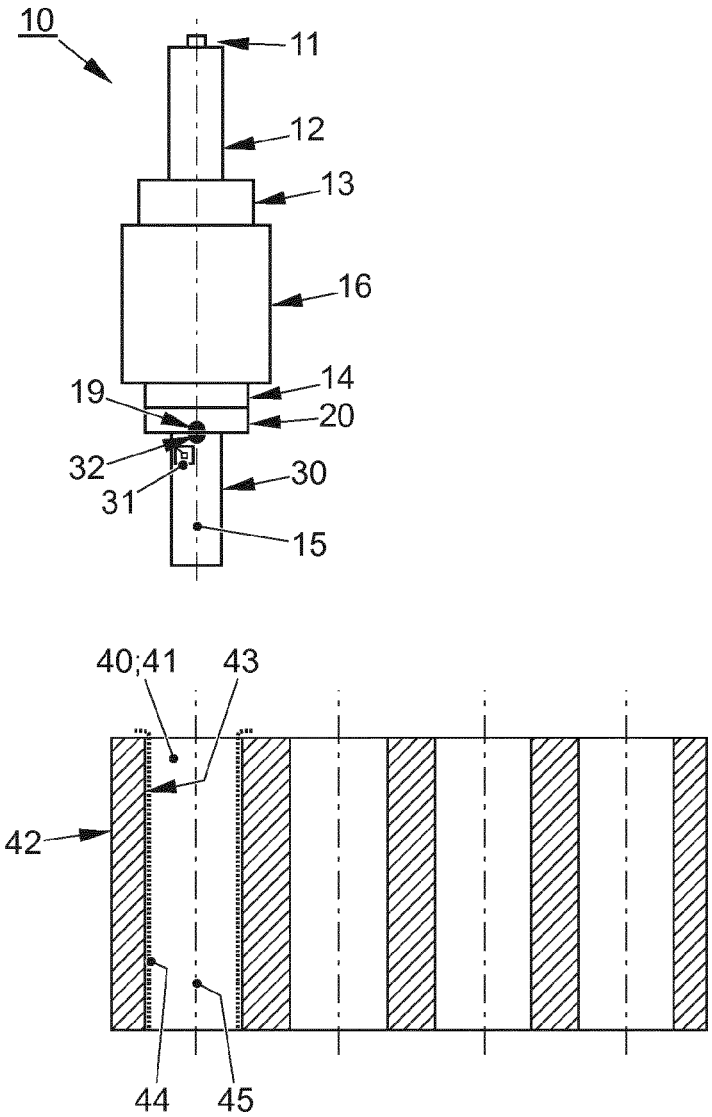
FIG. 1 shows a schematic representation of a rotating unit with an engine block.

A rotating unit 10 is shown schematically in FIG. 1, wherein the compactness of the construction of the rotating unit 10 with the rotary drive 13, implemented here as a hollow-shaft motor 13*a*, is easily discernible here. Provided on the extreme outside radially is a slip ring assembly 16, by means of which electric power can be transmitted to the coating lance 30. With regard to the common axis of rotation 15, the coating material feed 11, in which coating material for the coating lance 30 can be fed (from above according to this representation), is provided centrally in this design. Arranged to surround the coating material feed 11 and radially inside the hollow-shaft motor 13*a* is a process media feed 12, for example for process gas and/or cooling water. The tool holder 14 is provided coaxially under the slip ring assembly 16 and such that it can be rotated by the hollow-shaft motor 13*a*. Following this tool holder in this example is an (optional) reader 20, wherein the (optional) zero point marking 19 is also located on the reader 20 here. The inserted coating lance 30 has a corresponding zero point 32. The zero point 32 is aligned with the zero point marking 19. In addition, the coating lance 30 advantageously has an identification unit 31, for example an RFID chip, so that the inserted coating lance 30 can be automatically recognized by means of the reader 20. The coating lance 30 is shown here aligned with the cylinder axis 45, and has been withdrawn again from the interior 40 to be coated, here a cylinder bore 41 of an engine block 42, and has applied the desired coating 44 to the cylinder barrel 43 there.

Figure 2:
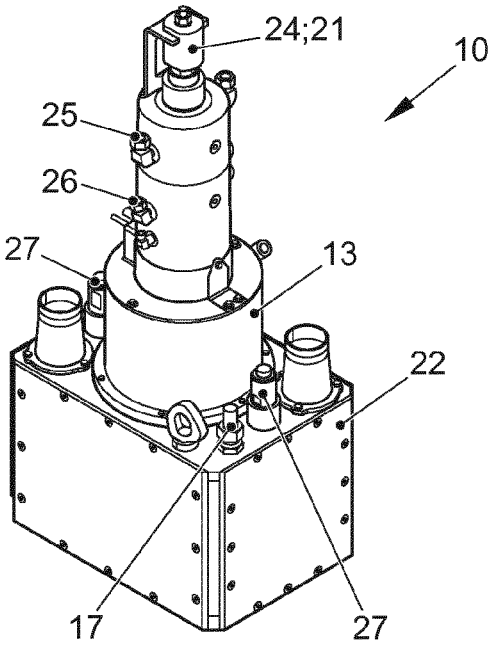
FIG. 2 shows a perspective view of a rotating unit without coating lance.
Figure 3:
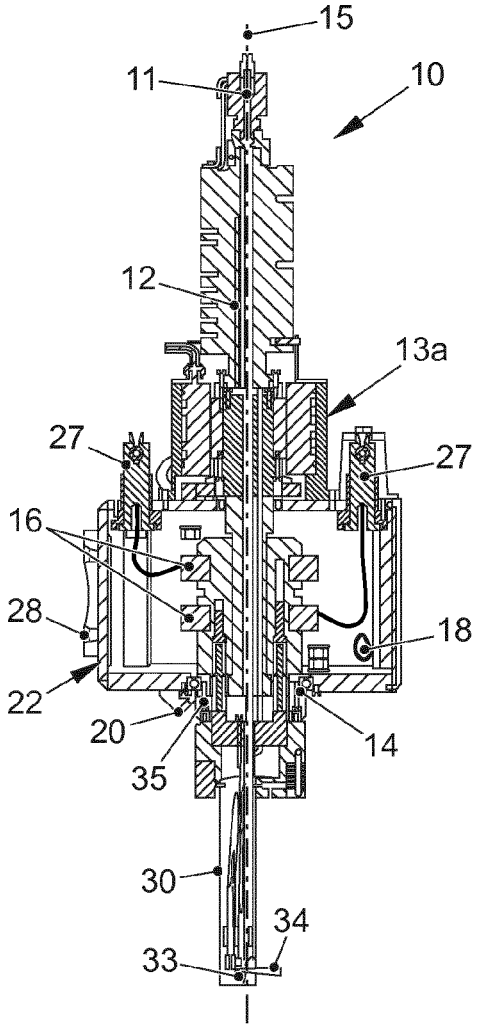
FIG. 3 shows a perspective sectional view of a rotating unit with coating lance.

Shown in FIG. 2 and FIG. 3 is one possible embodiment of a rotating unit 10, wherein in FIG. 2 the rotating unit 10 is shown in a perspective view without coating lance 30, and in FIG. 3 the rotating unit 10 is shown in a perspective sectional view with coating lance 30. In this design, a housing 22 and stationary supply connections are shown, namely a first supply connection 24 for coating material, preferably in powder or wire form, a second supply connection 25 for, e.g., cooling water, a third supply connection 26 for, e.g., process gas, and a fourth supply connection 27 for, e.g., electric power for the slip ring assembly 16. The housing 22 in this case serves primarily to provide a required bearing spacing for supporting the high rotational speed of the coating lance 30. In addition, the entire rotating unit 10 is connected by this housing 22 to a gantry or a robot. Also provided on the housing is an exhaust system 17, of which the exhaust connection is labeled in FIG. 2, and wherein the exhaust system 17 is (optionally) assisted by an air jet 18 (see FIG. 3). It should be noted here that the component that includes the supply connections 24 to 26, as well as the housing 22, are stationary, and thus are not rotated about the axis of rotation 15. Only the centrally located components, including the tool holder 14 and the coating lance 30, are rotatable about the axis of rotation 15. For this purpose, the first supply connection 24 has, for example, a (known) sealed and encapsulated roller bearing 21, for example in accordance with the SPS series from the DSTI company. The housing 22 has a mounting connection 28 by means of which the rotating unit 10 is movable horizontally and vertically in a coating lance device 100 (see FIG. 4). Shown at the bottom of the coating lance 30 in the representation is the coating nozzle 33, which can be inserted into an interior 40 (see FIG. 1), and shown schematically is a coating stream 34. Shown at the upper end of the coating lance 30 at the tool holder 14 in the representation is a lance connection 35 in the immediate vicinity of the (optional) reader 20, for example an RFID reader.

Figure 4:
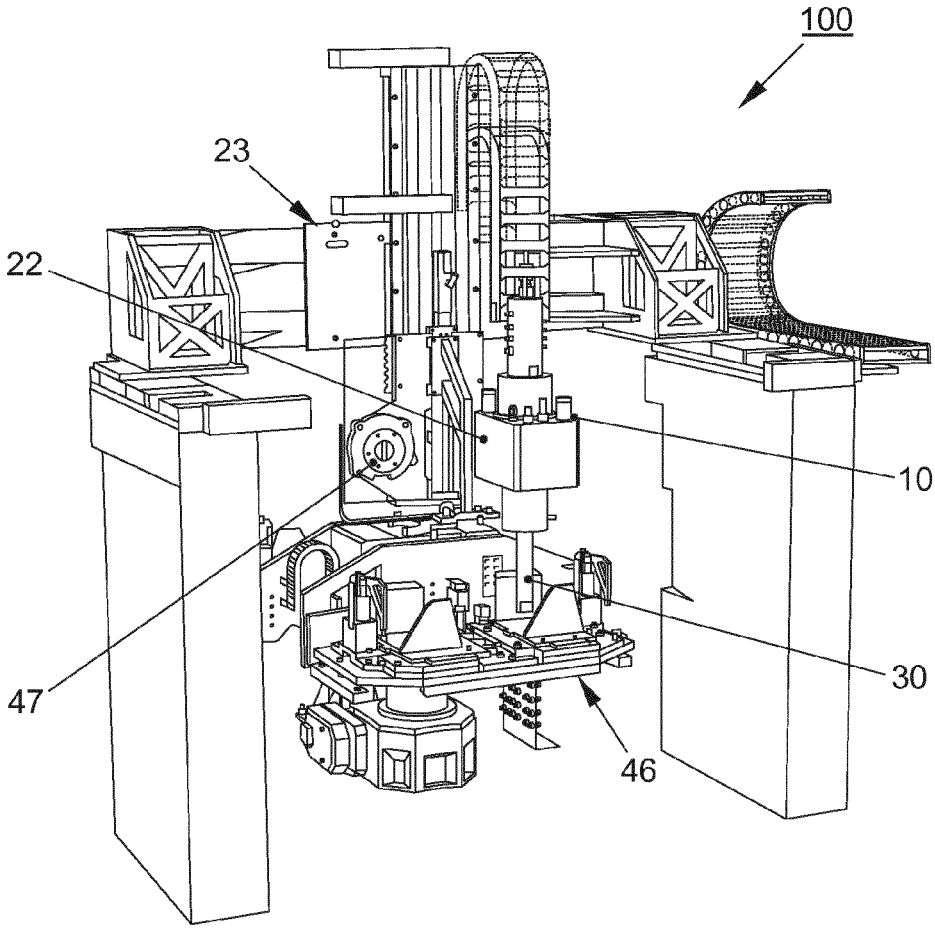
FIG. 4 shows a perspective view of a coating lance device.

Shown in FIG. 4 is a simplified coating lance device 100, in which two rotating units 10, each with a coating lance 30, can be advanced in a gantry by means of a linear actuator 23 along a horizontal axis and along a vertical axis toward a workpiece table 46, for example for an engine block 42 (see FIG. 1). Here, only one rotating unit 10 is shown, along with the mating connection 47 for the mounting connection 28 (see FIG. 3) of the housing 22 for a second rotating unit, preferably of identical design.

The rotating unit proposed here permits low-vibration or vibration-free operation at high speeds for a coating lance for thermal coating.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A rotating unit for a coating lance device for thermally coating an interior of a cylinder bore of an engine block, the rotating unit comprising:

a tool holder for a coating lance with an axis of rotation;

a rotary drive for rotating the tool holder about the axis of rotation;

a coating material feed for supplying the coating lance with a coating material;

a process media feed for providing process media for coating an interior via the coating lance mounted in the tool holder, wherein the rotary drive is a hollow-shaft motor arranged coaxial with the axis of rotation of the tool holder, and wherein the tool holder and the coating material feed, as well as the process media feed are located centrally relative to the hollow-shaft motor.

2. The rotating unit according to claim 1, wherein a slip ring assembly for transmitting electric power to the coating lance is located radially outside the hollow-shaft motor.

3. The rotating unit according to claim 2, wherein an exhaust system for removing slip ring dust from the slip ring assembly is provided, and wherein at least one air jet is also provided via which removal of the slip ring dust is assisted.

4. The rotating unit according to claim 1, wherein the tool holder is equipped to mount different coating lances and has a zero point marking for precisely repeatable alignment of a relevant coating lance, and has a reader for reading an identification information item of the applicable mounted coating lance.

5. The rotating unit according to claim 1, wherein the coating material is provided in powder form, and at least one gas-tight, encapsulated, and low-wear roller bearing is provided for coupling in the coating material, and wherein the roller bearing is at least partially made of ceramic.

6. A coating lance device for thermally coating an interior of a cylinder bore of an engine block, the coating lance device comprising:

at least one rotating unit according to claim 1;

at least one linear actuator for axial and/or lateral positioning of the rotating unit relative to an interior to be coated; and stationary supply connections for supplying electricity to the hollow-shaft motor and the coating lance and for the coating material feed and for the process media feed.

* * * * *